US008212739B2

(12) United States Patent
Sievenpiper

(10) Patent No.: US 8,212,739 B2
(45) Date of Patent: Jul. 3, 2012

(54) MULTIBAND TUNABLE IMPEDANCE SURFACE

(75) Inventor: Daniel F. Sievenpiper, Santa Monica, CA (US)

(73) Assignee: HRL Laboratories, LLC, Malibu, CA (US)

( * ) Notice: Subject to any disclaimer, the term of this patent is extended or adjusted under 35 U.S.C. 154(b) by 1449 days.

(21) Appl. No.: 11/803,775

(22) Filed: May 15, 2007

(65) Prior Publication Data

US 2010/0066629 A1 Mar. 18, 2010

(51) Int. Cl.
*H01Q 15/02* (2006.01)

(52) U.S. Cl. ..... 343/909; 343/700 MS

(58) Field of Classification Search ..... 343/909, 343/700 MS, 834, 912
See application file for complete search history.

(56) References Cited

U.S. PATENT DOCUMENTS

| | | | |
|---|---|---|---|
| 2,763,860 | A | 9/1956 | Ortusi et al. |
| 3,267,480 | A | 8/1966 | Lerner |
| 3,810,183 | A | 5/1974 | Krutsinger et al. |
| 3,961,333 | A | 6/1976 | Purinton |
| 4,150,382 | A | 4/1979 | King |
| 4,169,268 | A | 9/1979 | Schell et al. |
| 4,228,437 | A | 10/1980 | Shelton |
| 4,266,203 | A | 5/1981 | Saudreau et al. |
| 4,370,659 | A | 1/1983 | Chu et al. |
| 4,387,377 | A | 6/1983 | Kandler |
| 4,594,595 | A | 6/1986 | Struckman |
| 4,737,795 | A | 4/1988 | Nagy et al. |
| 4,749,996 | A | 6/1988 | Tresselt |
| 4,782,346 | A | 11/1988 | Sharma |
| 4,829,309 | A | 5/1989 | Tsukamoto et al. |
| 4,835,541 | A | 5/1989 | Johnson et al. |
| 4,843,400 | A | 6/1989 | Tsao et al. |
| 4,843,403 | A | 6/1989 | Lalezari et al. |
| 4,853,704 | A | 8/1989 | Diaz et al. |
| 4,905,014 | A | 2/1990 | Gonzalez et al. |

(Continued)

FOREIGN PATENT DOCUMENTS

| | | |
|---|---|---|
| DE | 196 00 609 | 4/1997 |

(Continued)

OTHER PUBLICATIONS

Balanis, C., "Aperture Antennas", Antenna Theory, Analysis and Design, 2nd Edition, (New York, John Wiley & Sons, 1997), Chap. 12, pp. 575-597.

(Continued)

*Primary Examiner* — Jacob Y Choi
*Assistant Examiner* — Kyana R McCain
(74) *Attorney, Agent, or Firm* — Ladas & Parry

(57) ABSTRACT

A tunable impedance surface capable of steering a multiband radio frequency beam in two different, independently bandwise controllable directions. The tunable surface has a ground plane and a plurality of first conductive elements disposed in a first array a first distance therefrom, the first distance being less than a wavelength of a lower frequency band of the multiband radio frequency beam. A first capacitor arrangement controllably varies capacitance between selected ones of the first conductive elements. A plurality of second conductive elements are disposed in a second array a second distance from the plurality of first conductive elements, the second distance being less than a wavelength of a higher frequency band of the multiband radio frequency beam, the plurality of first conductive elements serving as a ground plane for the plurality of second conductive elements. A second capacitor arrangement controllably varies capacitance between selected ones of the second conductive elements.

22 Claims, 8 Drawing Sheets

U.S. PATENT DOCUMENTS

| | | | | |
|---|---|---|---|---|
| 5,021,795 | A | 6/1991 | Masiulis | |
| 5,023,623 | A | 6/1991 | Kreinheder et al. | |
| 5,070,340 | A | 12/1991 | Diaz | |
| 5,081,466 | A | 1/1992 | Bitter, Jr. | |
| 5,115,217 | A | 5/1992 | McGrath et al. | |
| 5,146,235 | A | 9/1992 | Frese | |
| 5,158,611 | A | 10/1992 | Ura et al. | |
| 5,160,936 | A * | 11/1992 | Braun et al. | 343/725 |
| 5,208,603 | A | 5/1993 | Yee | |
| 5,268,701 | A | 12/1993 | Smith | |
| 5,287,118 | A | 2/1994 | Budd | |
| 5,325,094 | A | 6/1994 | Broderick et al. | |
| 5,402,134 | A | 3/1995 | Miller et al. | |
| 5,519,408 | A | 5/1996 | Schnetzer | |
| 5,525,954 | A | 6/1996 | Komazaki et al. | |
| 5,531,018 | A | 7/1996 | Saia et al. | |
| 5,532,709 | A | 7/1996 | Talty | |
| 5,534,877 | A | 7/1996 | Sorbello et al. | |
| 5,541,614 | A | 7/1996 | Lam et al. | |
| 5,557,291 | A | 9/1996 | Chu et al. | |
| 5,589,845 | A | 12/1996 | Yandrofski et al. | |
| 5,611,940 | A | 3/1997 | Zettler | |
| 5,638,946 | A | 6/1997 | Zavracky | |
| 5,694,134 | A | 12/1997 | Barnes | |
| 5,721,194 | A | 2/1998 | Yandrofski et al. | |
| 5,874,915 | A | 2/1999 | Lee et al. | |
| 5,892,485 | A | 4/1999 | Glabe et al. | |
| 5,894,288 | A | 4/1999 | Lee et al. | |
| 5,905,465 | A | 5/1999 | Olson et al. | |
| 5,905,466 | A | 5/1999 | Jha | |
| 5,917,458 | A | 6/1999 | Ho et al. | |
| 5,923,303 | A | 7/1999 | Schwengler et al. | |
| 5,945,951 | A | 8/1999 | Monte et al. | |
| 5,949,382 | A | 9/1999 | Quan | |
| 5,949,387 | A | 9/1999 | Wu et al. | |
| 5,965,494 | A | 10/1999 | Terashima et al. | |
| 6,005,519 | A | 12/1999 | Burns | |
| 6,008,770 | A | 12/1999 | Sugawara | |
| 6,040,803 | A | 3/2000 | Spall | |
| 6,054,659 | A | 4/2000 | Lee et al. | |
| 6,075,485 | A | 6/2000 | Lilly et al. | |
| 6,081,235 | A | 6/2000 | Romanofsky et al. | |
| 6,097,263 | A | 8/2000 | Mueller et al. | |
| 6,097,343 | A | 8/2000 | Goetz et al. | |
| 6,118,406 | A | 9/2000 | Josypenko | |
| 6,118,410 | A | 9/2000 | Nagy | |
| 6,127,908 | A | 10/2000 | Bozler et al. | |
| 6,154,176 | A | 11/2000 | Fathy et al. | |
| 6,166,705 | A | 12/2000 | Mast et al. | |
| 6,175,337 | B1 | 1/2001 | Jasper et al. | |
| 6,191,724 | B1 | 2/2001 | McEwan | |
| 6,208,316 | B1 | 3/2001 | Cahill | |
| 6,218,978 | B1 | 4/2001 | Simpkin et al. | |
| 6,246,377 | B1 | 6/2001 | Aiello et al. | |
| 6,262,495 | B1 | 7/2001 | Yablonovitch et al. | |
| 6,323,826 | B1 | 11/2001 | Sievenpiper | |
| 6,366,254 | B1 | 4/2002 | Sievenpiper | |
| 6,426,722 | B1 | 7/2002 | Sievenpiper | |
| 6,483,480 | B1 | 11/2002 | Sievenpiper et al. | 343/909 |
| 6,483,481 | B1 | 11/2002 | Sievenpiper et al. | 343/909 |
| 6,496,155 | B1 | 12/2002 | Sievenpiper | |
| 6,512,494 | B1 | 1/2003 | Diaz et al. | 343/909 |
| 6,518,931 | B1 | 2/2003 | Sievenpiper | |
| 6,525,695 | B2 | 2/2003 | McKinzie | 343/756 |
| 6,538,621 | B1 | 3/2003 | Sievenpiper et al. | 343/909 |
| 6,552,696 | B1 * | 4/2003 | Sievenpiper et al. | 343/909 |
| 6,628,242 | B1 | 9/2003 | Hacker et al. | 333/246 |
| 6,670,932 | B1 | 12/2003 | Diaz et al. | 343/909 |
| 6,690,327 | B2 | 2/2004 | McKinzie et al. | 343/700 MS |
| 6,774,866 | B2 * | 8/2004 | McKinzie et al. | 343/909 |
| 6,774,867 | B2 | 8/2004 | Diaz et al. | 343/909 |
| 6,812,903 | B1 | 11/2004 | Sievenpiper | |
| 7,683,854 | B2 * | 3/2010 | Sievenpiper et al. | 343/909 |
| 2002/0167457 | A1 * | 11/2002 | McKinzie et al. | 343/909 |

FOREIGN PATENT DOCUMENTS

| | | |
|---|---|---|
| EP | 0 539 297 | 4/1993 |
| EP | 1 120 856 | 8/2001 |
| FR | 2 785 476 | 5/2000 |
| GB | 2 281 662 | 3/1995 |
| GB | 2 328 748 | 3/1999 |
| WO | 94/00891 | 1/1994 |
| WO | 96/29621 | 9/1996 |
| WO | WO 98/21734 | 5/1998 |
| WO | WO 99/50929 | 10/1999 |
| WO | WO 00/44012 | 7/2000 |
| WO | PCT/US2007/080635 | * 10/2007 |

OTHER PUBLICATIONS

Balanis, C., "Microstrip Antennas", Antenna Theory, Analysis and Design, 2nd Edition, (New York, John Wiley & Sons, 1997), Chap. 14, pp. 722-736.

Bradley, T.W., et al., "Development of a Voltage-Variable Dielectric (VVD), Electronic Scan Antenna," Radar 97, Publication No. 449, pp. 383-385 (Oct. 1997).

Cognard, J., "Alignment of Nematic Liquid Crystals and Their Mixtures" Mol. Cryst. Liq. Cryst. Suppl. 1, 1 (1982)pp. 1-74.

Doane, J.W., et al., "Field Controlled Light Scattering from Nematic Microdroplets", Appl. Phys. Lett., vol. 48 (Jan. 1986) pp. 269-271.

Ellis, T.J. and G.M. Rebeiz, "MM-Wave Tapered Slot Antennas on Micromachined Photonic Badgap Dielectrics," 1996 IEEE MTT-S International Microwave Symposium Digest, vol. 2, pp. 1157-1160 (1996).

Jensen, M.A. et al., "EM Interaction of Handset Antennas and a Human in Personal Communications", Proceedings of the IEEE, vol. 83, No. 1 (Jan. 1995) pp. 7-17.

Jensen, M.A., et al., "Performance Analysis of Antennas for Handheld Transceivers using FDTD", IEEE Transactions on Antennas and Propagation, vol. 42, No. 8 (Aug. 1994) pp. 1106-1113.

Linardou, I., et al., "Twin Vivaldi antenna fed by coplanar waveguide," Electronics Letters, vol. 33, No. 22, pp. 1835-1837 (Oct. 23, 1997).

Ramos, S., et al., Fields and Waves in Communication Electronics, 3rd Edition (New York, John Wiley & Sons, 1994) Section 9.8-9.11, pp. 476-487.

Schaffner, J.H., et al., "Reconfigurable Aperture Antennas Using RF MEMS Switches for Multi-Octave Tunability and Beam Steering," IEEE, pp. 321-324 (2000).

Sievenpiper, D. and Eli Yablonovitch, "Eliminating Surface Currents with Metallodielectric Photonic Crystals," 1998 IEEE MTT-S International Microwave Symposium Digest, vol. 2, pp. 663-666 (Jun. 7, 1998).

Sievenpiper, D., "High-Impedance Electromagnetic Surfaces", Ph. D. Dissertion, Dept. of Electrical Engineering, University of California, Los Angeles, CA, 1999.

Sievenpiper, D., et al., "Low-profile, four sector diversity antenna on high-impedance ground plane," Electronics Letters, vol. 36, No. 16, pp. 1343-1345 (Aug. 3, 2000).

Sievenpiper, D., et. al., "High-Impedance Electromagnetic Surfaces with a Forbidden Frequency Band", IEEE Transactions on Microwave Theory and Techniques, vol. 47, No. 11, (Nov. 1999) pp. 2059-2074.

Vaughan, Mark J., et al., "InP-Based 28 GHz Integrated Antennas for Point-to-Multipoint Distribution", IEEE, pp. 75-84 (1995).

Wu, S.T., et al., "High Birefringence and Wide Nematic Range Bistolane Liquid Crystals", Appl. Phys. Lett. vol. 74, No. 5, (Jan. 1999) pp. 344-346.

* cited by examiner

MULTIBAND TUNABLE IMPEDANCE SURFACE

CROSS REFERENCE TO RELATED PATENTS

This application is related to the technology disclosed by the following US patents: D. Sievenpiper, T-Y Hsu, S-T Wu, D. Pepper, "Electronically Tunable Reflector", U.S. Pat. No. 6,552,696; D. Sievenpiper, R. Harvey, G. Tangonan, R. Loo, J. Schaffner, "Tunable Impedance Surface", U.S. Pat. No. 6,538,621; D. Sievenpiper, J. Schaffner, "Textured Surface Having High Electromagnetic Impedance in Multiple Frequency Bands", U.S. Pat. No. 6,483,481; and D. Sievenpiper, G. Tangonan, R. Loo, J. Schaffner, "Tunable Impedance Surface", U.S. Pat. No. 6,483,480. The disclosures of afore-identified US patents are hereby incorporated herein by reference.

TECHNICAL FIELD

This application discloses a dual band tunable impedance surface which can be used in antenna applications to provide independent antenna beam steering in two bands.

BACKGROUND INFORMATION

Over the past several years, HRL Laboratories of Malibu, Calif. has developed the concept of the tunable impedance surface, which can be used for electronically steerable antennas. A new application has for this technology emerged, in which very lightweight antennas are needed, for which a tunable impedance surface is well qualified. However, this particular application requires independent two-frequency operation, and the tunable impedance antennas proposed to date do not provide for independent multiple frequency operation. In this disclosure, we describe how two-frequency operation (and, more generally, multiple frequency operation) can be obtained with a tunable impedance surface. This invention provides simultaneous electronic steering in both (or all) bands. It is an improvement of the prior art tunable impedance surface concepts, it is thin and lightweight, and ideally suited to the application for which it was designed, to be described below. The technology described herein in terms of two frequency operation can be expanded to allow multiple band operation with independent beam steering in each band, so long as the bands are sufficiently separated from one another (they need be spaced at least an octave apart).

This invention represents an improvement over prior art tunable impedance surfaces, because it is capable of providing electronic beam steering in two (or more) frequency bands independently and simultaneously. In the past, dual band high-impedance surfaces have been studied, but these were not tunable. Using these previous designs, it would not be possible to tune both bands independently. This invention provides independent tuning in both bands, as long as the two bands are separated by at least one octave in frequency.

This antenna could be used as part of a large stratospheric airship for remote sensing. Because the antenna is based on the tunable impedance surface concept, it is thin compared to the wavelength of interest. If made of lightweight materials, as described below, it can be light enough that even large area antennas (tens or hundreds of square meters) can be carried on a lighter-than-air craft that can be operated in the stratosphere.

The closest prior art is that of tunable impedance surfaces, and dual band high impedance surfaces. The prior art includes the patents listed below:

R. Diaz, W. McKinzie, "Multi-Resonant High Impedance Electromagnetic Surfaces", U.S. Pat. No. 6,774,867.

W. McKinzie, S. Rogers, "Multiband Artificial Magnetic Conductor", U.S. Pat. No. 6,774,866.

W. McKinzie, V. Sanchez, "Mechanically Reconfigurable Artificial Magnetic Conductor", U.S. Pat. No. 6,690,327.

R. Diaz, W. McKinzie, "Multi-Resonant High-Impedance Surfaces Containing Loaded Loop Frequency Selective Surfaces", U.S. Pat. No. 6,670,932.

J. Hacker, M. Kim, J. Higgins, "High-Impedance Structures for Multifrequency Antennas and Waveguides", U.S. Pat. No. 6,628,242.

D. Sievenpiper, T-Y Hsu, S-T Wu, D. Pepper, "Electronically Tunable Reflector", U.S. Pat. No. 6,552,696.

D. Sievenpiper, R. Harvey, G. Tangonan, R. Loo, J. Schaffner, "Tunable Impedance Surface", U.S. Pat. No. 6,538,621.

W. McKinzie, "Reconfigurable Artificial Magnetic Conductor Using Voltage Controlled Capactors with Coplanar Resistive Biasing Network", U.S. Pat. No. 6,525,695.

R. Diaz, W. McKinzie, "Multi-Resonant High-Impedance Electromagnetic Surfaces", U.S. Pat. No. 6,512,494.

D. Sievenpiper, J. Schaffner, "Textured Surface Having High Electromagnetic Impedance in Multiple Frequency Bands", U.S. Pat. No. 6,483,481.

D. Sievenpiper, G. Tangonan, R. Loo, J. Schaffner, "Tunable Impedance Surface", U.S. Pat. No. 6,483,480.

FIG. 1(*a*) depicts a prior art single-band tunable impedance surface 5, both in a plan view and in a side section view, which consists of an array of metal patches 10 that are connected by tunable capacitors, such as varactor diodes 15, arranged above a conductive ground plane 12. The metal patches 10 are connected alternately to the ground plane 12 or to a set of control lines 17 through a sheet of dielectric material 19 disposed between the metal plates 10 and the ground plane 12. When a voltage is applied to the control lines 17, the resonance frequency of the surface is tuned, and this effect can be used to steer a reflected radio frequency (RF) beam.

The FIG. 1(*b*) is a graph of exemplary curves showing the reflection phase as a function of frequency for different control voltages for the tunable surface of FIG. 1(*a*). For a frequency within the tuning range of the surface, nearly any desired phase can be produced by applying the correct control voltages to the control lines 17.

When a pattern of voltages is applied to the control wires, the tunable capacitors are tuned to a pattern of capacitance values. The reflection phase of the surface depends on the value of the capacitors, and is also a function of frequency. The pattern of capacitances results in a pattern of reflection phases. By tuning the surface to create a phase gradient, a reflected wave is steered to an angle that depends on the phase gradient.

Therefore, the tunable impedance surface of FIG. 1(*a*) may be used as a beam steering reflector as shown in FIG. 2(*a*) where an incoming RF beam is reflected at a desired angle as a reflected RF beam. A phase gradient is created using the tuning method described above. A wave reflected by the surface is steered to an angle that depends on the phase gradient. FIG. 2(*b*) depicts the measured beam steering results of the single band surface shown in the previous figures. The different radiation patterns correspond to different sets of control voltage applied to the control lines. Using this reflective beam steering method, the tunable surface is typically fed using a free-space feed method, such as a horn antenna that is set apart from the surface.

FIG. 3(*a*) shows an alternative method of feeding the tunable surface, with a conformal feed. This technique is used when the entire antenna must occupy a short height, and a space feed either cannot be used or is not desired. Beam steering is more difficult with this feed technique, but it eliminates the need for a space feed. In this case, the feed is a small antenna 7 such as a dipole, located near the surface. The feed excites surface waves in the surface. The surface waves propagate across the surface, and radiate to form a beam in a direction that depends on the pattern of control voltages applied to the tunable capacitors. FIG. 3(*b*) depicts an example of a measured radiation pattern using the direct feed method shown in FIG. 3(*a*). The beam is broad because the surface is small. Many such tiles can be combined to make a narrow, steerable beam without the need for a space feed.

The present invention is described in the context a dual-band tunable impedance surface in which both bands are independently tunable. It is based on, and an improvement of, the prior art tunable impedance surface designs, which are described in the patent documents identified above. It is capable of dual band operation through the use of a different principle than the prior art multi-band surfaces. The design can be extended to so that more than two bands can be independently tunable.

This present invention is useful for applications where antennas that are capable of independent beam steering in two different frequency bands are required. It is particularly useful for air or space based structures, where lightweight structures are important. In particular, such an antenna could be used in stratospheric airships, which must be lightweight.

BRIEF DESCRIPTION OF THE DRAWINGS

FIG. 1(*b*) depicts exemplary curves showing the reflection phase as a function of frequency for different control voltages for the surface of FIG. 1(*a*).

FIG. 2(*b*) shows the measured beam steering results of the single band surface shown in the previous figures. The different radiation patterns correspond to different sets of control voltage.

FIG. 3(*b*) is a graph depicting an example of a measured radiation pattern using the direct feed method shown in the previous figure.

FIG. 4(*a*) is a planar section view a portion of the preferred embodiment of a two band tunable high impedance surface taken as depicted in FIG. 4, namely, immediately above patches 111.

FIG. 4(*b*) is a planar section view a portion of the preferred embodiment of a two band tunable high impedance surface taken as depicted in FIG. 4, namely, immediately above wiring layer 113.

FIG. 4(*c*) is a planar section view a portion of the embodiment of a two band tunable high impedance surface taken immediately above patches 107.

DETAILED DESCRIPTION OF A PREFERRED EMBODIMENT

An important feature of the dual band tunable surface disclosed herein is that it is capable of simultaneous beam steering in two frequency bands, and that beams in the two bands are independently steerable.

Tunable impedance surfaces are generally composed of small metal patches, as described above. These are typically close to ¼ wavelength on a side for the frequency band of interest. If two bands of interest are widely separated in frequency, such as, for example, 450 MHz and 10 GHz, then the metal patches for the two bands will significantly different in size. If the difference is great (more than a factor of 2) then a single patch for the lower frequency band can serve as the ground plane for many patches in the higher frequency band. This is illustrated in FIG. 4 which is a side section view through a small portion of an embodiment of a multiband tunable impedance surface in accordance with the present invention.

Figure 2A:
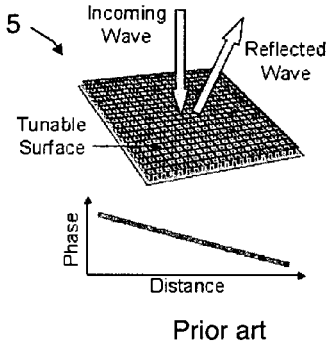
FIG. 2(*a*) depicts the tunable impedance surface used as a beam steering reflector.
Figure 2B:
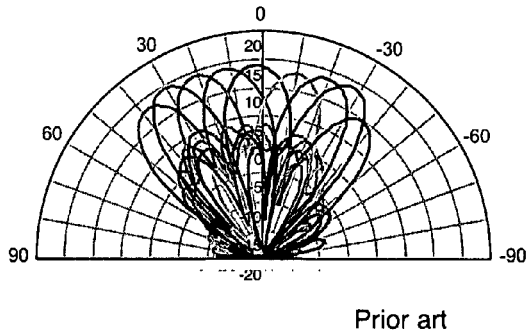

The dual band tunable impedance surface disclosed herein may be used in such applications as those shown in FIGS. 2(*a*) and 3(*a*). However, instead of just steering one RF beam, the present dual band impedance surface can be used to steer FIG. 4 depicts an embodiment of a dual band tunable impedance surface 100, with its impedance being individually (independently) tunable for two radio frequency bands, one relatively higher and one relatively lower in frequency. Only a small portion of the entire structure making up the tunable impedance surface is depicted in this side elevation view. The actual structure 100 may have a total thickness of less than about 11 mm for a surface operating at 450 Mhz with a bandwidth of 10% of the operating frequency. The depiction of FIG. 4 is enlarged in size many times (for a surface operating at 450 Mhz) to make more clear the internal configuration of this particular embodiment.

Figure 1A:
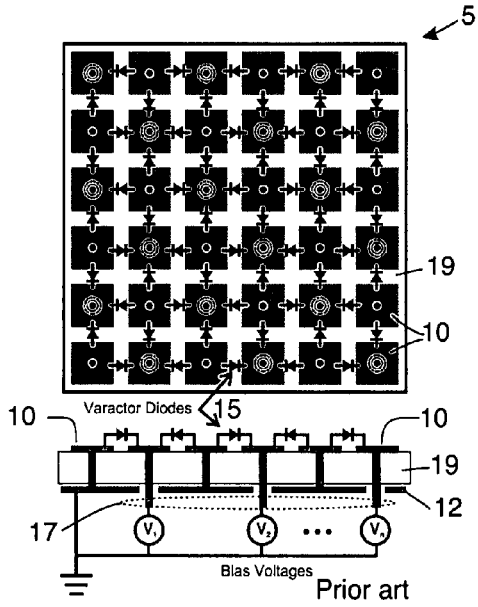
FIG. 1(*a*) depicts a prior art single-band tunable impedance surface which consists of a sheet of metal patches that are connected by varactor diodes.
Figure 1B:
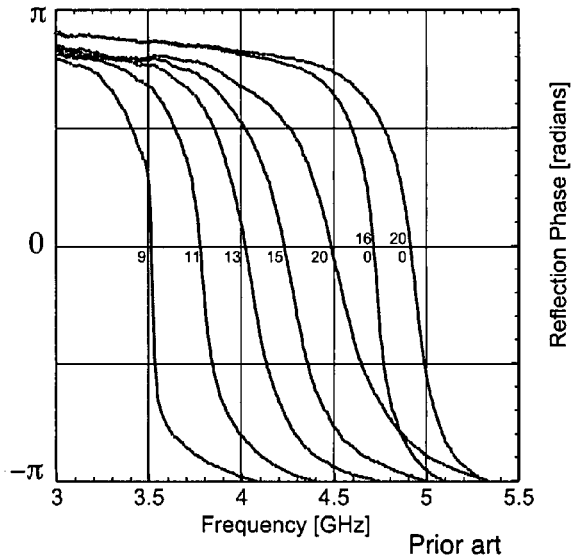
Figure 4:
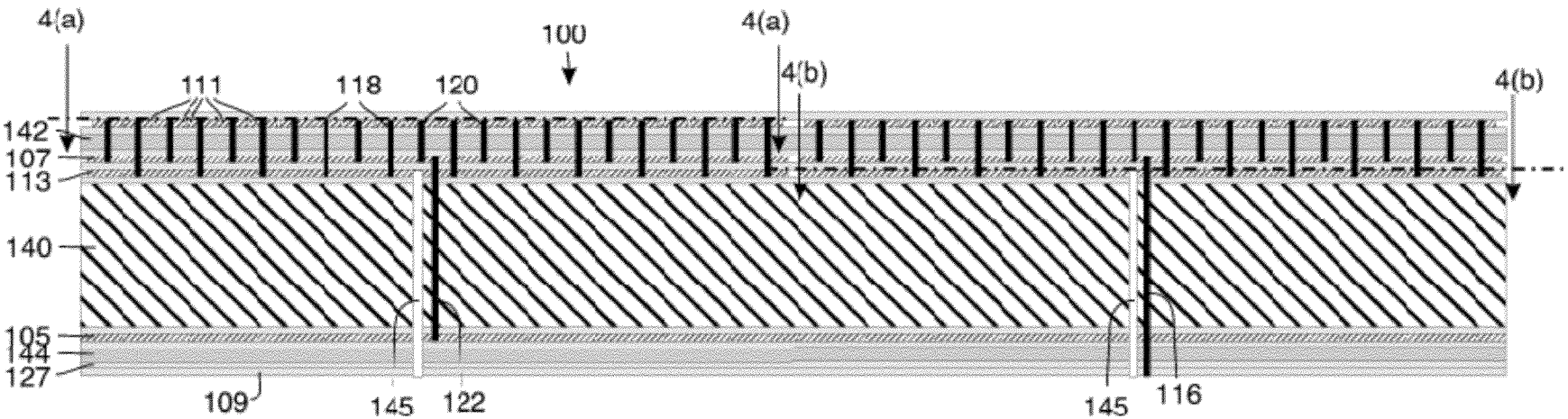
FIG. 4 is a side sectional view of a portion of an embodiment of a two band tunable high impedance surface according to the present invention. Several unit cells for the low-band, and many for the high band, of the dual band tunable reflector. The blue lines are for control signals that feed the control chip for the high band panels, shown as a blue rectangle in the lower right section of the upper portion of the figure.
Figure 4A:
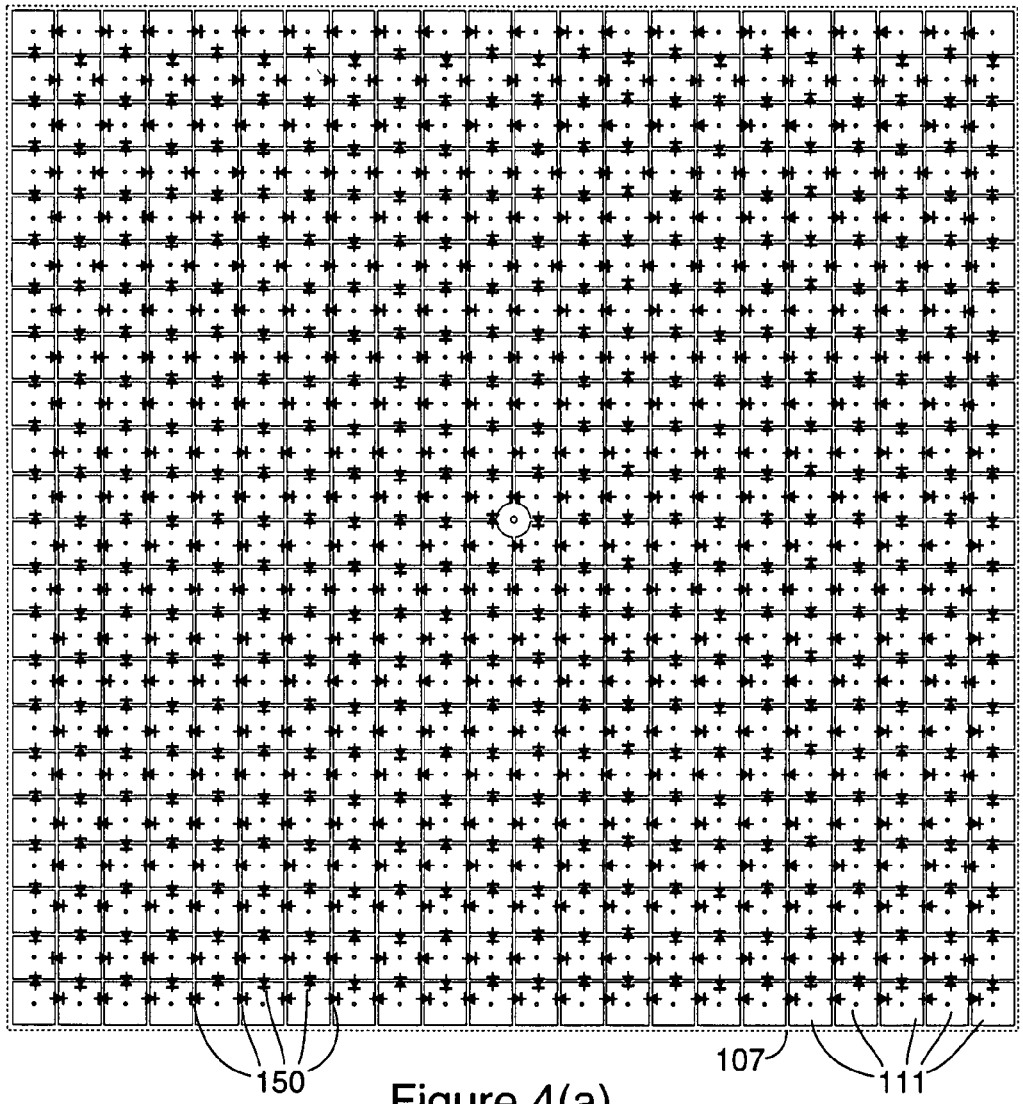
Figure 4B:
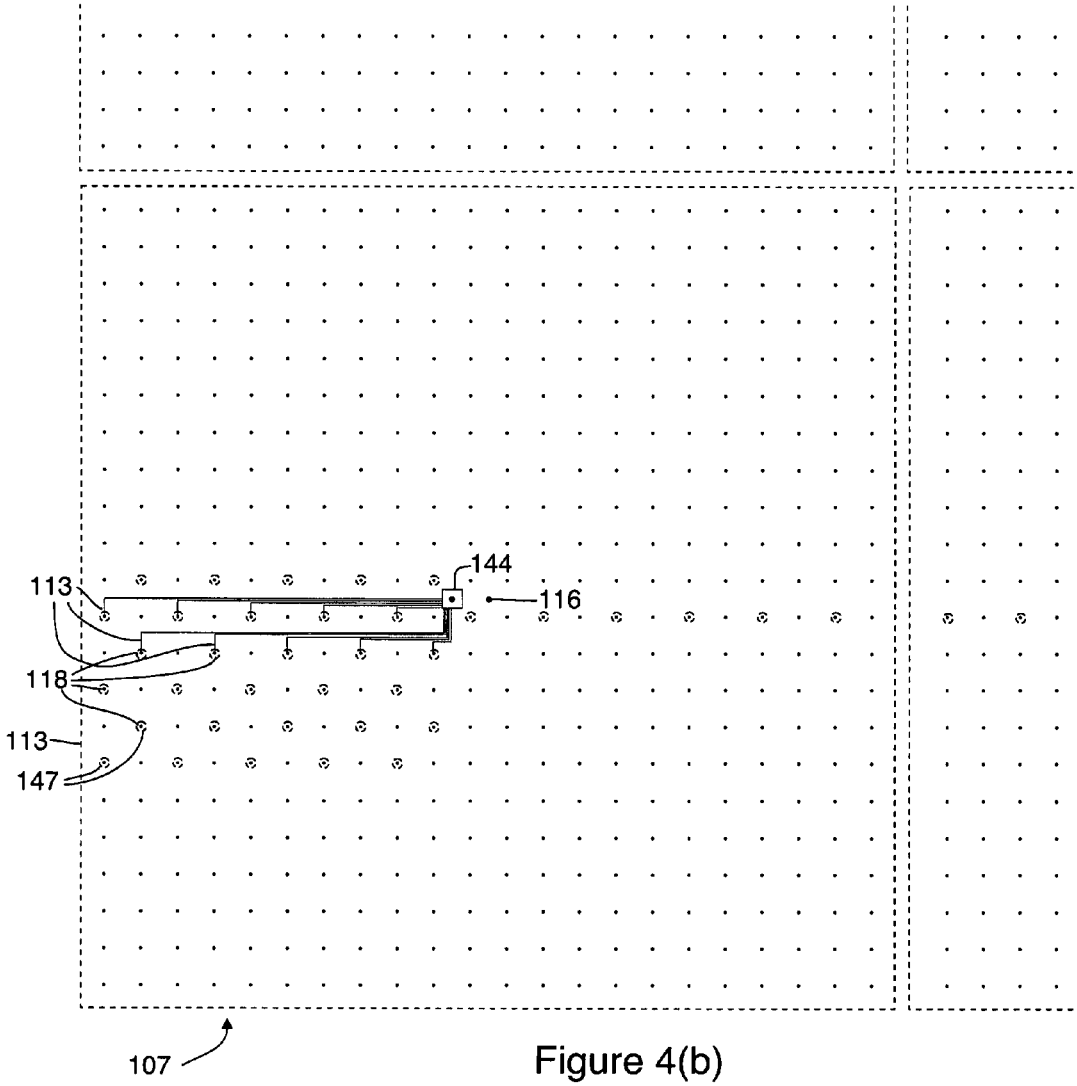
Figure 4C:
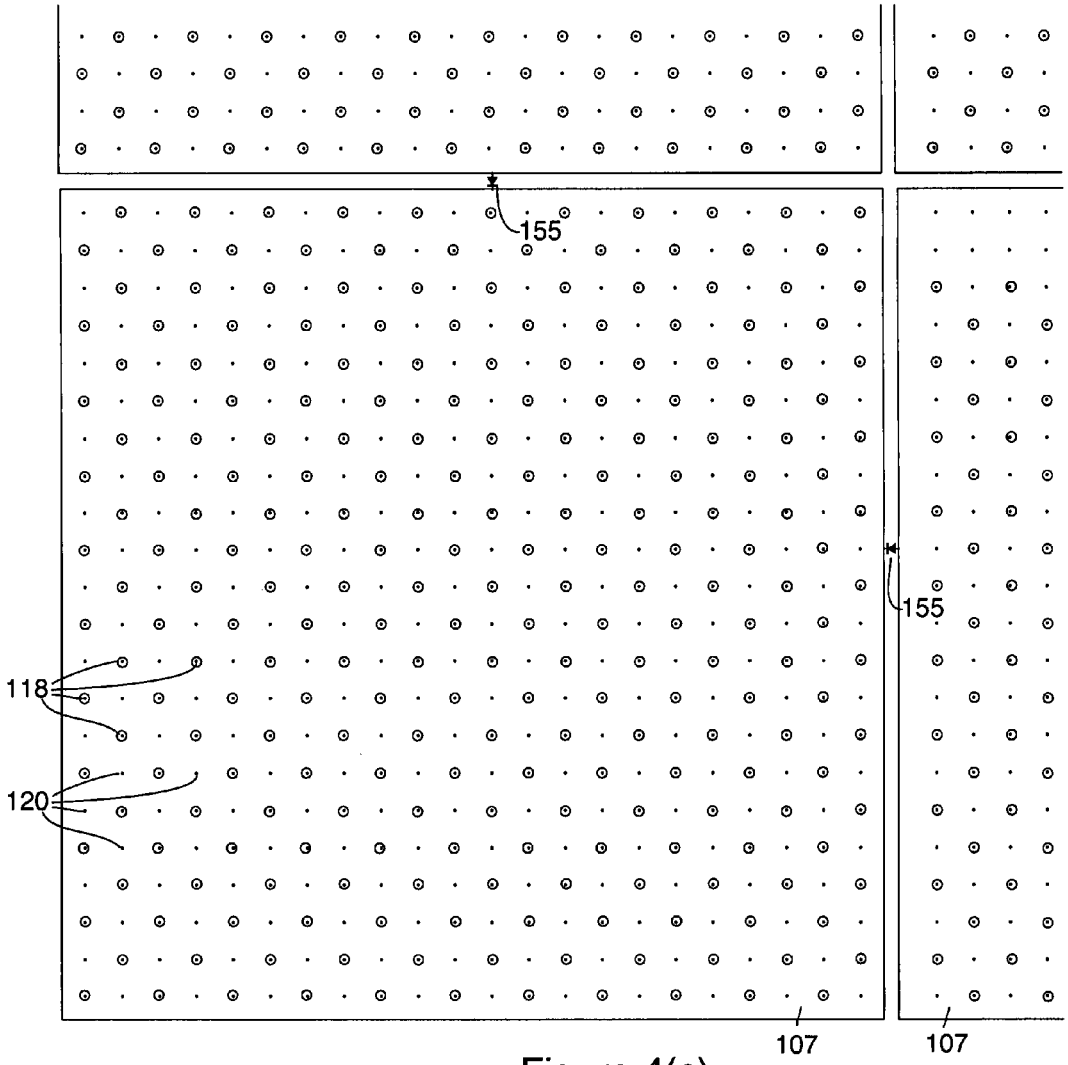

The structures shown in FIG. 4 repeat many times and, indeed, the individual patches 111 and 107 are preferably of a square shape when viewed in a plan view (see FIG. 4(*a*)) and therefore they repeat in much the same fashion as do the prior art patches 5 shown the FIG. 1. A major difference compared to the prior art is that there is a set of relatively smaller square patches 111, useful in a relatively higher frequency band, and a set of larger square patches 107, useful in a relatively lower frequency band, and the surface impedance functions presented by these arrays of relatively smaller and relatively larger patches can be separately controlled, by band, so that in FIG. 2(*a*), if the incoming wave had two different frequency bands associated with it and was reflected from the front surface 101 of the tunable impedance surface embodiment of FIG. 4, the frequency bands could be differentiated one from the other and reflected in different directions.

The larger (lower frequency) patch 107 has in this embodiment twenty-two smaller (higher frequency) patches 111 disposed more or less along one of its edges. And when viewed in plan view, one larger patch 107 in this embodiment has twenty-two smaller patches 111 disposed along each of its edges so that twenty-two squared ($22^2$) smaller patches overly it, as can be seen in FIG. 4(*a*). The number twenty-two, in this embodiment, is selected as a function of the particular frequency bands in the tunable surface is designed to independently steer or reflect radio frequency energy and thus the ratio of the number of smaller patches 111 to the number of larger patches 107 is varied as need be to suit the frequencies involved.

In this embodiment electrically conductive (and preferably metallic) regions have reference numbers in the 105-115 range. Thin insulating layers, which can be Kapton® or another suitable dielectric and preferably flexible material, have reference numbers in the 125-139 range. Thin foam dielectric layers (which can also be made with other materials) have reference numbers in the 140-149 range. Foam is preferred for these layers due to its light weight compared with other dielectrics. But foam is a difficult media to print circuit layers on, so more conventional dielectric surfaces, e.g. the type used in printed circuit board printing technologies such as Kapton®, may alternatively be used, instead of a foam, for the convenience of printing conductors thereon even if the their weight per unit volume of material is greater than foam dielectric materials.

Vertical vias, which are electrically conductive and preferably metallic, have reference numbers in the 116-124 range. The relatively thick substrate 140, which is associated with the lower frequency band, is preferably a closed cell dielectric substrate, such as those made by Hexcell Corporation, but other dielectric materials may be used if desired. The thick substrate 140 preferably has thin dielectric films on its two major surfaces. Thin dielectric films are also depicted on the major surfaces of layers 142 and 144 and between layers 107 and 113 for example. These thin dielectric films may have a thickness of only about 0.5 μm.

The varactors are not shown in FIG. 4 for ease of illustration, but they are located between neighboring patches for both the lower and higher frequency bands, as is shown in the more detail views of FIGS. 4(*a*) and 4(*c*).

When a layer has a numeral falling in the metallic (for example) range that is not meant to indicated that the layer is 100% metallic (for example). Sometimes the 'metallic' layers include metal patches, which are spaced from one another within a layer and the regions between patches in a layer will be dielectric in nature (and hence preferably non-metallic). Other times the 'metallic' layers comprises a number of signal lines in a layer which are insulated one from another. Also the term 'metallic' is intended to refer to the fact that in the preferred embodiments, metal is used for the patches 107 and 111 and a ground plane 105; however, it should be understood that while these patches 107 and 111 and the ground plane 105 need to be electrically conductive and are preferably formed using conventional printer circuit manufacturing technologies, they can conceptually be made out of non-metallic, but electrically conductive materials if desired. So while a metal is often preferred for these elements, other materials may be successfully substituted therefor and the invention does not require that a metal be used for these elements and/or layers.

The tunable impedance surface structures for the lower frequency band consist of a ground plane 105, the larger plates or patches 107, and the relatively thick substrate 140, which takes up most of the thickness of the entire structure shown in FIG. 4, and of course, their associated capacitors (preferably varactors) 155 shown in FIG. 4(*c*). Each of the relatively larger plates 107 is addressed through the relatively long vertical vias 116 or 122, preferably disposed at the center of each plate 107.

Bias lines for controlling the varactors 155 are preferably disposed on or in a separate layer 109 below the ground plane 105. A single metal layer 109 can contain bias lines for both the lower and higher frequency bands, or these tasks may be divided into several layers as desired. In such an embodiment, additional layers 109 can be added to the depicted structure, below the lowest layer shown in FIG. 4, with suitable dielectric layer(s) in between (as needed), similar or identical to dielectric layer 127.

The tunable impedance surface for the higher frequency band consists of: (i) the plates 107 for the lower band, which serve as a ground planes for the groups of smaller plates or patches 111 located immediately above each plate 107, which plates or patches 111 are associated with the higher frequency band, and (ii) the smaller plates or patches 111 which serve the higher frequency band in much the same way that the larger plates or patches 107 serve the lower frequency band. The dielectric layer 142 for the higher frequency band is much thinner in this embodiment than dielectric layer 140 associated with the lower frequency band.

Control lines 152 for the higher frequency band varactors 150 (see FIG. 4(*a*)) are preferably fed from the control layer (or layers) 109 on the back of the structure, towards the front surface 102 of the tunable impedance surface 100, where the higher frequency band RF structures are located, using a control bus 145, running alongside or parallel to the bias lines (or control lines) 116 for the lower frequency band structures.

A separate control layer 113 may be located below the patches 107 for the lower frequency band (which also serve as the ground plane for the higher frequency band) for distribution of control signals to varactors 150. In FIG. 4 the control layers 113 and 109 is depicted much like a solid material—but that is only for ease of illustration—the control layers preferably comprise many control wire or leads disposed on a neighboring or adjacent dielectric layer. Control layer 113 is shown in greater detail in FIG. 4(*b*), but the control lines for only a few of the varactors 150 are shown—again for ease of illustration—but those skilled in the art will appreciate that similar control lines are preferably run to the cathodes of each varactor 150 shown in FIG. 4(*a*) The anodes of the varactors 150 are grounded to ground plane 107 through vias 120. If desired, the polarity of the varactor diodes 150 may be reversed by reversing the polarities of their control signals accordingly. The layer above the control layer, namely patches 107, are shown in dashed lines in FIG. 4(*a*) to show their positional relationships to the control lines 113 in the control layer.

The cathodes of the varactors 150 are preferably connected to the control lines shown in layer 113 though vias 118. A large number of control signals can be routed through a narrow space by encoding the required control signals on a single transmission line (such as via 145), which signals are preferably routed to a chip 144 via line 145, chip 144 being located in the control layer 109 preferably under (and near) the geometrical center of each large patch 107. The chip 155 decodes the required control signals, and generates individual control voltages for the varactors 150 associated with each small (high-band) patch 111. The control voltages are communicated from the control layer 113 to the ungrounded side of each varactor 150 through vias 118. The other side of each higher frequency varactor 150 is more to less "grounded" as it is coupled to the larger plates 107 (through vias 120) which plates 107 function as a ground plate for the higher frequency band structures and as a variable impedance surface for the lower frequency band structures. As with single band tunable impedance surfaces, it is only required that every other patch be supplied with a control signal, as the other patches are effectively grounded.

Because the beam steering mechanism for tunable impedance surfaces is based on a resonance phenomena, it occurs only over a narrow bandwidth—typically as low as a few percent to as much as several tens of percent of the center frequency of the frequencies of interest. Because of this, the state of the surface in each of the two bands does not affect the other band if they are sufficiently separated in their respective operating frequencies, as previously mentioned. Waves in the lower frequency band do not "see" the small patches 111 of the upper frequency band structure and the relatively small capacitors 150 that link them together. Similarly, the gaps which separate the plates 107 of the lower frequency band structures only appear as only a series of slots 107 in a ground plane at the frequencies of interest to the upper frequency band are considered, which slots 107 do not have a significant effect because there are relatively few of them compared to the number of small patches 111. The independence of the two frequency bands is increased as the difference in frequency is increased beyond, for example, an octave.

Figure 5:
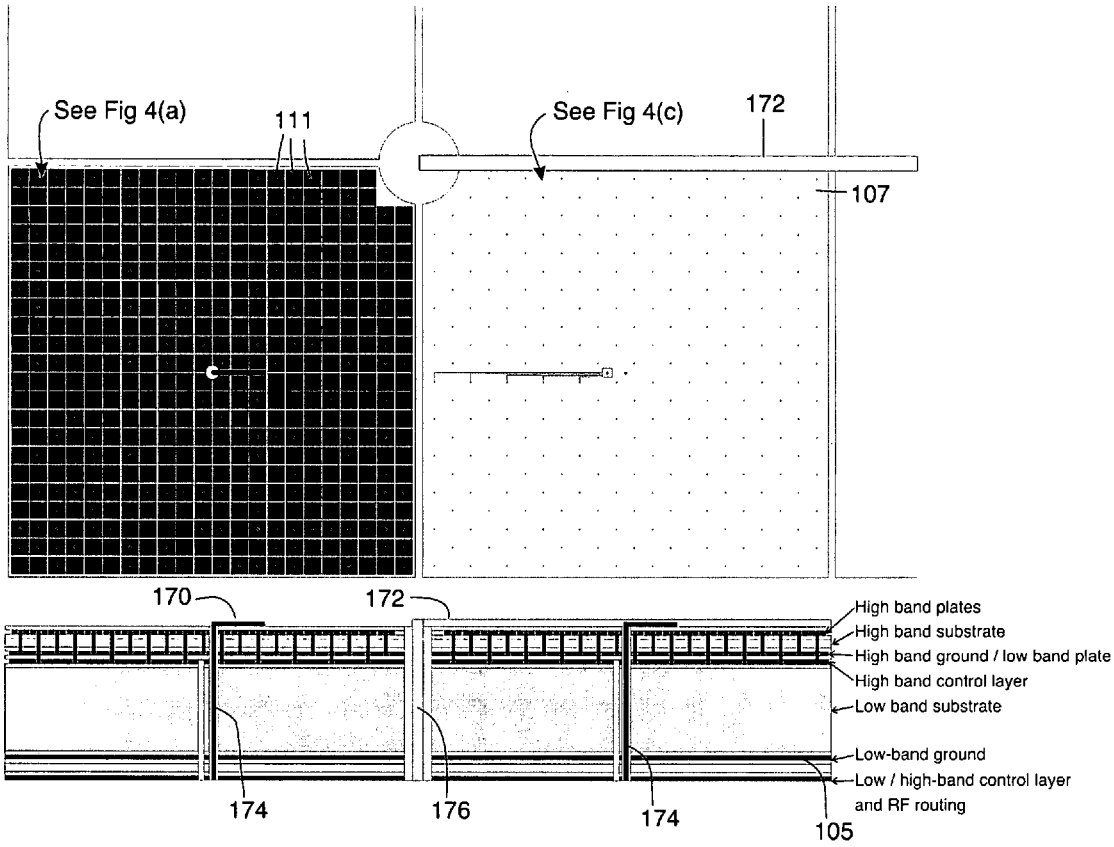
FIG. 5, which is very similar to that of FIG. 4, depicts the dual band tunable surface, used in a direct feed application. A single feed addresses each panel for the high band. That panel serves as a single unit cell for the low band. The low band feed is shown as a thick grey wire in the upper portion of the figure.

Direct feed techniques are possible with multi-band surfaces, just as they are with single-band surfaces. An example or embodiment of such a surface is shown in FIG. 5. It is identical to the embodiment shown in the FIGS. 4, 4(*a*)-4(*c*) except that it includes feed structures for both the low frequency (see element 172) and high frequency (see element 170) bands. The high band feeds are small wire antennas 170 that are preferably fed through a coaxial cable 174. The inner conductor of the coaxial cable 174 ends at and is connected to one end of the feed 170 itself. The outer conductor of the coaxial cable 174 may be used as the bias line for one of the low-band patches 107, so it is preferably either attached to the low-band ground plane 105 or to one of the control lines for the low-band portion of the surface. The low-band antenna 172 is a longer wire structure that is attached to a separate coaxial cable 176, shown in the figure.

FIG. 5 is a composite of FIGS. 4, 4(*a*) and 4(*b*). The right hand side of this figure corresponds to the view of FIG. 4(*b*) and thus the higher layers (above the 4(*b*) section line of FIG. 4), have been stripped away to expose layer 107. Of course, in use, layer 107 is covered with the layers depicted in the section view portion of FIG. 5.

Figure 6:
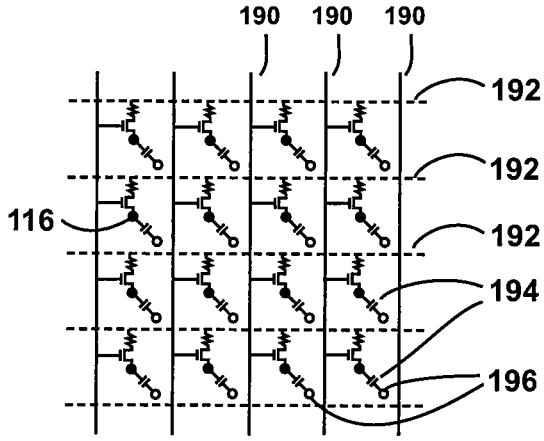
FIG. 6 depicts a circuit for controlling the voltage on each varactor using a row-and-column addressing scheme. When a positive voltage is applied to a vertical wire, the voltages on the horizontal wires are set on each capacitor. All of the voltages can be programmed by sequentially applying a voltage to each vertical, and the desired voltages to all horizontal wires.

Both the low and high band portions of the structure can be biased using a row-and-column scheme, as shown in FIG. 6. Wires 190 are activated to determine which column is to be programmed with a set of voltages. Wires 192, which are isolated from wires 190 preferably by a thin dielectric layer (not shown), carry those voltages to an array of patches 111, which are attached by a vertical via 116, shown as a black circle in FIG. 6. A voltage is applied to one wire 190 at a time, and the entire array is programmed column by column. The voltage is stored in a set of capacitors 194, which are shown in FIG. 6. A second via 196, shown as an open circle, is attached to ground plane 105 that serves as a common voltage reference.

Just as the high band structure is a smaller version of the low band structure, the dual band tunable surface described herein can be extended to multiple bands by adding additional layers, where each successively higher band is a scaled version of the lower bands.

Figure 7A:
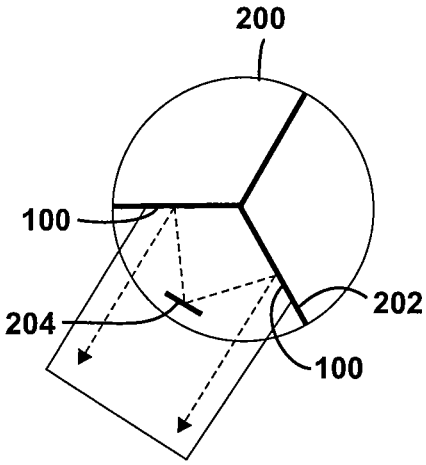
FIG. 7(*a*) depicts the geometry of the stratospheric platform that is one application for this invention. The surface could be used in reflection mode, using panels located on the interior of the craft, and a separate feed array FIG. 7(*b*) shows how the surface could be made conformal to the outside of the craft, constructed as many small patterns that would appear smooth on a large scale.
Figure 7B:
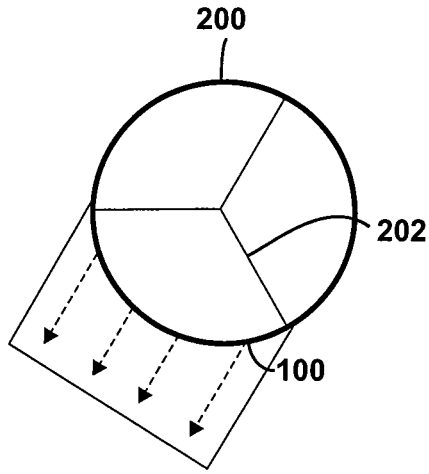

The dual band tunable surface is particularly suited to certain space or airborne applications, because it can perform as a steerable antenna at two frequencies, while also being very thin and lightweight. FIGS. 7(*a*) and 7(*b*) shows how it could be used as part of an inflatable structure (such as a light than air ship or other airplane having a body 200 with internal structures 202) that could be located in the stratosphere, for remote sensing. Such a platform may need to operate in two bands, such as 450 MHz and 10 GHz, and the dual band tunable surface 100 could fill that role. If it were used in reflection mode, as in FIGS. 2 and 4, then the dual band tunable surface 100 would preferably be suspended on internal struts 202 within the airship, and illuminated from feed horns 204 located near the surface of the airship. Only one pie-shaped segment of the airship is shown with an illuminated the dual band tunable surface 100 in FIG. 7(*a*), but it is to be understood the other two pie-shaped segments may be similarly provided with feed horns and dual band tunable surfaces 100 to provide additional coverage.

Figure 3A:
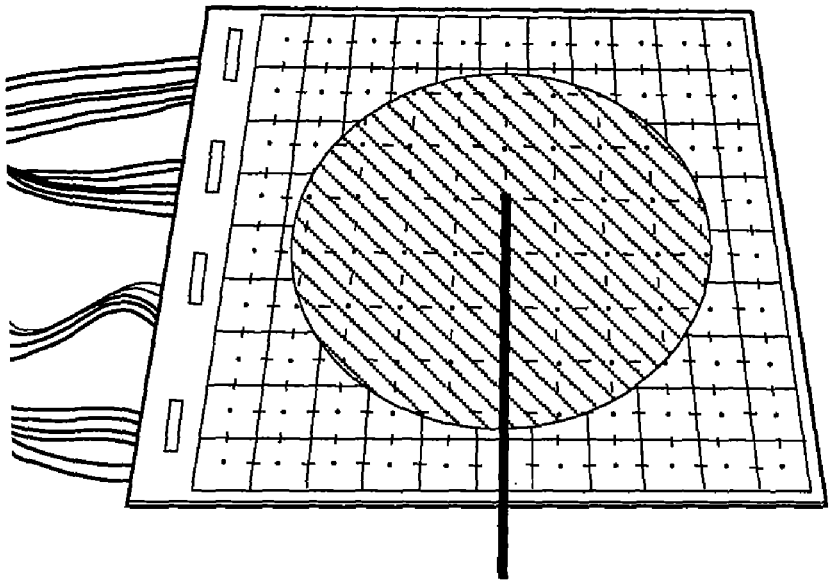
FIG. 3(a) Prior Art
FIG. 3(*a*) depicts an alternative method for feeding the tunable surface, with a conformal feed.
Figure 3B:
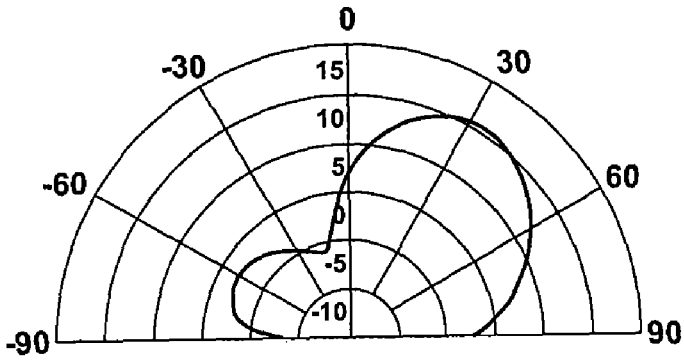
FIG. 3(b) Prior Art

If the dual band tunable surface 100 were used in direct-feed mode, as in FIGS. 3(*a*) and 5 then it would be preferably attached to the external skin of the airship. See FIG. 7(*b*). In this embodiment, the dual band tunable surface 100 would be built as individual thin panels that may be one to several meters in size on a side. The panels would be arranged on the outside of the airship. By using many small panels, the panels could be made to conform to a curved shape following the exterior surface 200 of the airship, even though each panel may be individually flat.

Set forth below in Table I is an estimate of the mass density of the dual band tunable surface 100 using typical lightweight materials that would be suitable for a stratospheric airship. The mass density is approximately 1500 grams per square meter. Of course, the density would vary depending on the choice of materials. A list of assumptions is also given, in which the thickness and preferred choice of materials is provided.

Assumptions:

1. X-band substrate is foam, with density of 3 pounds/ft$^3$ such as Airex Baltek B-2.50
2. UHF substrate is hex core material, with density of 1.5 pounds/ft$^3$ such as Hexcel HRH-10-¼-1.5
3. All dielectric layers are separated by layers of 1 mil kapton, at 1.42 g/cm$^3$, for printing circuit layers
4. All copper is mesh, with effective density of ⅛ ounce/ft$^2$
5. X-band feed layer is equivalent to ¼ ounce/ft$^2$ copper at 10% area density
6. Two control layers are each similar density to X-band feed layer
7. UHF structure is 3.18 cm thick
8. UHF plate is ¼ wavelength, or 16 cm wide
9. There is 1 X-band feed per UHF plate
10. X-band structure is 0.14 cm thick
11. X-band plate is ¼ wavelength, or 0.75 cm wide
12. Vias have equivalent thickness of 1 ounce copper, 1 mm diameter
13. Cable for x-band feed is 77 pounds/1000 ft such as Belden 7810 coax
14. Varactors are 1 cubic millimeter of silicon at 2330 kg/m$^3$

TABLE I

| Component | g/m$^2$ |
|---|---|
| UHF hex substrate | 763.2 |
| X-band foam substrate | 67.2 |
| back circuit layer foam | 67.2 |
| 7 thin dielectric (Kapton) layers | 248.5 |
| Feeds: 39 X-band and 1 UHF | 152.2 |
| 3 copper layers | 114.4 |
| 1 feed layer | 7.6 |
| 2 DC control layers | 15.2 |
| X-band vias | 23.8 |
| UHF vias | 1.2 |
| varactors | 82.8 |
| total | 1543.3 |

The disclosed dual band tunable surface 100 should be sufficient light in weight that it can successfully used used on or in an airship.

Having described this invention in connection with a preferred embodiment thereof, further modification will now suggest itself to those skilled in the art. The invention is therefore not to be limited to the disclosed embodiment except as specifically required by the appended claims.

What is claimed is:

1. A tuneable impedance surface capable of steering a multiband radio frequency beam in at least two different, independently band-wise controllable directions, the tunable surface comprising:

(a) a ground plane;

(b) a plurality of first conductive elements disposed in a first array a first distance from the ground plane, the first distance being less than a wavelength of a lower frequency band of said multiband radio frequency beam;

(c) a first capacitor arrangement for controllably varying capacitance between at least selected ones of the first conductive elements in said first array for steering a first radio frequency beam in said lower frequency band in a first direction;

(d) a plurality of second conductive elements disposed in a second array a second distance from the plurality of first conductive elements disposed in the first array, the second distance being less than a wavelength of a higher frequency band of said multiband radio frequency beam, the plurality of second conductive elements disposed in the second array being spaced farther from said ground plane than said first distance, the plurality of first conductive elements disposed in the first array serving as a ground plane for the plurality of second conductive elements disposed in the second array; and (e) a second capacitor arrangement for controllably varying capacitance between at least selected ones of the second conductive elements in said second array for steering a second radio frequency beam in said higher frequency band in a second direction independently of said first direction.

2. The tuneable impedance surface of claim 1 wherein the tuneable impedance surface is illuminated with radio frequency radiation by at least one horn antenna aimed at said tuneable impedance surface.

3. The tuneable impedance surface of claim 1 wherein the tuneable impedance surface is fed by wire antenna structures disposed on said tuneable impedance surface.

4. The tuneable impedance surface of claim 1 wherein the first capacitor arrangement comprises a first array of varactor capacitors and the second capacitor arrangement comprises a second array of varactor capacitors.

5. The tuneable impedance surface of claim 4 wherein the first array of varactor capacitors are coupled between said plurality of first conductive elements disposed in said first array of elements and the second array of varactor capacitors are coupled between said plurality of second conductive elements disposed in said second array of elements.

6. A method of independently and simultaneously steering a multiband radio frequency beam in at least two different, independently band-wise controllable directions, the method comprising:

(a) providing a ground plane;

(b) disposing a plurality of first conductive elements in a first array a first distance from the ground plane, the first distance being less than a wavelength of a lower frequency band of said multiband radio frequency beam;

(c) providing a first capacitor arrangement for controllably varying capacitance between at least selected ones of adjacent first conductive elements in said first array for steering a first radio frequency beam in said lower frequency band in a first direction;

(d) disposing a plurality of second conductive elements in a second array a second distance from the plurality of elements disposed in the first array, the second distance being less than a wavelength of a higher frequency band of said multiband radio frequency beam, the plurality of second conductive elements disposed in the second array being spaced farther from said ground plane than said first distance, the plurality of first conductive elements disposed in the first array serving as a ground plane for the plurality of elements disposed in the second array;

(e) providing a second capacitor arrangement for controllably varying capacitance between at least selected ones of adjacent second conductive elements in said second array for steering a second radio frequency beam in said higher frequency band in a second direction independently of said first direction; and (f) coupling electrical signals to the first and second capacitor arrangements for steering the multiband radio frequency beam impinging at least the second conductive elements in at least two different, independently band-wise controllable directions.

7. The method of claim 6 wherein further including impinging the tuneable impedance surface radio frequency radiation by at least one horn antenna aimed at said tuneable impedance surface.

8. The method of claim 6 further including disposing wire antenna structures on said tuneable impedance surface.

9. The method of claim 6 wherein the first capacitor arrangement comprises a first array of varactor capacitors and the second capacitor arrangement comprises a second array of varactor capacitors.

10. The tuneable impedance surface of claim 9 further including coupling the first array of varactor capacitors between said plurality of first conductive elements disposed in said first array of elements and including coupling the second array of varactor capacitors between said plurality of second conductive elements disposed in said second array of elements.

11. A tuneable impedance surface comprising:

(a) a ground plane;

(b) a plurality of first conductive elements disposed in a first array a first distance from the ground plane;

(c) a first capacitor arrangement for controllably varying capacitance between at least selected ones of the first conductive elements in said first array;

(d) a plurality of second conductive elements disposed in a second array a second distance from the plurality of first conductive elements disposed in the first array, the plurality of second conductive elements disposed in the second array being spaced farther from said ground plane than said first distance, the plurality of first conductive elements disposed in the first array each serving as a ground plane for groups of the plurality of second conductive elements disposed in the second array; and (e) a second capacitor arrangement for controllably varying capacitance between at least selected ones of the second conductive elements in said second array.

12. The tuneable impedance surface of claim 11 wherein the tuneable impedance surface is illuminated with radio frequency radiation by at least one horn antenna aimed at said tuneable impedance surface.

13. The tuneable impedance surface of claim 11 wherein the tuneable impedance surface is fed by wire antenna structures disposed on said tuneable impedance surface.

14. The tuneable impedance surface of claim 11 wherein the first capacitor arrangement comprises a first array of varactor capacitors and the second capacitor arrangement comprises a second array of varactor capacitors.

15. The tuneable impedance surface of claim 14 wherein the first array of varactor capacitors are coupled between said plurality of first conductive elements disposed in said first array of elements and the second array of varactor capacitors are coupled between said plurality of second conductive elements disposed in said second array of elements.

16. The tuneable impedance surface of claim 11 wherein the plurality of first conductive elements disposed in the first array serve as a ground plane for both the plurality of second conductive elements disposed in the second array and for the second capacitor arrangement with individual capacitors in the second capacitor arrangement each being coupled in groups to an associated one of said plurality of first conductive elements.

17. A method of independently and simultaneously steering a multiband radio frequency beam in at least two different, independently band-wise controllable directions, the method comprising:

(a) providing a ground plane;

(b) disposing a plurality of first conductive elements in a first array a first distance from the ground plane;

(c) providing a first capacitor arrangement for controllably varying capacitance between at least selected ones of adjacent first conductive elements in said first array;

(d) disposing a plurality of second conductive elements in a second array a second distance from the plurality of elements disposed in the first array, the plurality of second conductive elements disposed in the second array being spaced farther from said ground plane than said first distance, the plurality of first conductive elements disposed in the first array serving as a ground plane for the plurality of elements disposed in the second array;

(e) providing a second capacitor arrangement for controllably varying capacitance between at least selected ones of adjacent second conductive elements in said second array; and (f) coupling electrical signals to the first and second capacitor arrangements for steering the multiband radio frequency beam impinging at least the second conductive elements in at least two different, independently band-wise controllable directions.

18. The method of claim 17 wherein further including impinging the tuneable impedance surface radio frequency radiation by at least one horn antenna aimed at said tuneable impedance surface.

19. The method of claim 17 further including disposing wire antenna structures on said tuneable impedance surface.

20. The method of claim 17 wherein the first capacitor arrangement comprises a first array of varactor capacitors and the second capacitor arrangement comprises a second array of varactor capacitors.

21. The method surfacc of claim 20 further including coupling the first array of varactor capacitors between said plurality of first conductive elements disposed in said first array of elements and including coupling the second array of varactor capacitors between said plurality of second conductive elements disposed in said second array of elements.

22. The method of claim 20 wherein the plurality of first conductive elements disposed in the first array serve as a ground plane for both the plurality of second conductive elements disposed in the second array and for the second capacitor arrangement with individual capacitors in the second capacitor arrangement each being coupled in groups to an associated one of said plurality of first conductive elements.

* * * * *